US006397177B1

(12) United States Patent
Isabelle

(10) Patent No.: US 6,397,177 B1
(45) Date of Patent: May 28, 2002

(54) SPEECH-ENCODING RATE DECISION APPARATUS AND METHOD IN A VARIABLE RATE

(75) Inventor: Steven Isabelle, San Diego, CA (US)

(73) Assignee: Samsung Electronics, Co., Ltd. (KR)

( * ) Notice: Subject to any disclaimer, the term of this patent is extended or adjusted under 35 U.S.C. 154(b) by 0 days.

(21) Appl. No.: 09/265,455

(22) Filed: Mar. 10, 1999

(51) Int. Cl.[7] ..... G10L 19/14
(52) U.S. Cl. ..... 704/221; 704/223
(58) Field of Search ..... 704/221, 223

(56) References Cited

U.S. PATENT DOCUMENTS 5,414,796 A * 5/1995 Jacobs et al. ..... 704/221
5,657,420 A * 8/1997 Jacobs et al. ..... 704/223
5,742,734 A * 4/1998 DeJaco et al. ..... 704/226
5,778,338 A * 7/1998 Jacobs et al. ..... 704/223
6,104,993 A * 8/2000 Ashley ..... 704/227
6,122,610 A * 9/2000 Isabelle ..... 704/226

* cited by examiner

*Primary Examiner*—Richemond Dorvil
*Assistant Examiner*—Michael N. Opsasnick
(74) *Attorney, Agent, or Firm*—Dilworth & Barrese, LLP

(57) ABSTRACT

An apparatus and method for determining a speech-encoding rate in a variable rate vocoder are disclosed. A set of thresholds are computed based on background noise energy and its variation. A signal energy value of an input signal is computed, and a rate decision is made based on comparisons of the computed signal energy value with the computed thresholds. In one embodiment, a preliminary rate and a hangover interval are first computed based on the comparisons. The preliminary rate decision is then modified to take into account hangover constraints, a long term prediction gain and minimum and maximum rate constraints.

28 Claims, 1 Drawing Sheet

SPEECH-ENCODING RATE DECISION APPARATUS AND METHOD IN A VARIABLE RATE

BACKGROUND OF THE INVENTION

1. Field of the Invention

The present invention relates generally to vocoders, and more particularly, to an apparatus and method for determining a speech-encoding rate in a variable rate vocoder capable of encoding speech at several rates.

2. Description of the Related Art

Variable rate vocoders can potentially encode speech using fewer bits than fixed-rate vocoders with comparable quality. Variable-rate vocoders achieve this bit-rate reduction by encoding each segment of a speech signal with a number of bits that is related to the signal's properties. For instance, pauses in the speech signal will typically be encoded with fewer bits than high-energy speech.

By making bit-rate decisions frequently, using short segments of speech (e.g. 20 millisecond segments), a variable rate vocoder can produce high quality encoded speech. Ultimately, however, the quality of the compressed speech produced by a variable-rate vocoder depends on the compression algorithm itself as well as the algorithm used to choose the encoding bit rate.

One example of a variable rate vocoder is the Enhanced Variable Rate Codec (EVRC) described in the International Telecommunications Union (ITU) interim standard IS-127. The IS-127 rate-decision algorithm is an example of a speech-activity-based technique. The IS-127 rate decision algorithm determines the rate at which the current frame of 160 speech samples (of duration 20 ms) will be encoded. The algorithm bases its decisions on the first 17 bandwidth-expanded autocorrelation coefficients of the current frame and the gain of a long term predictor.

The IS-127 rate-decision algorithm requires processing in two different frequency bands, which are determined by a band-splitting filter. According to the IS-127 rate-decision algorithm, the rate decision is implemented independently in each of two frequency bands and the high rate between them is selected. Then, the selected rate is modified to take into account hangover constraints and minimum and maximum rate constraints to thereby determine a final rate. The hangover and the other constraints are provided from an external controller.

According to the algorithm, in each frequency band, a threshold is used for the rate decision. The threshold is computed using a signal-to-noise ratio (SNR) and background noise energy. The SNR calculation requires an accurate estimate of the average signal level. Additionally, the IS-127 rate decision algorithm has a high computational complexity.

SUMMARY OF THE INVENTION

It is an object of the present invention to provide an apparatus and method for determining a speech-encoding rate with features that eliminate the need for an accurate estimate of a signal-to-noise ratio and the bandsplitting as required in the IS-127 rate decision algorithm (RDA).

A further object of the present invention is to reduce the computational complexity of the IS-127 rate decision algorithm.

To achieve the above and other objects of the present invention there is provided an apparatus and method for determining a speech-encoding rate in a variable rate vocoder. A set of thresholds are computed based on background noise energy and its variation. A signal energy value of an input signal is computed, and a rate decision is made based on comparisons of the computed signal energy value with the computed thresholds. In one embodiment, a preliminary rate and a hangover interval are first computed based on the comparisons. The preliminary rate decision is then modified to take into account hangover constraints, a long term prediction gain and minimum and maximum rate constraints.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

Figure 1:
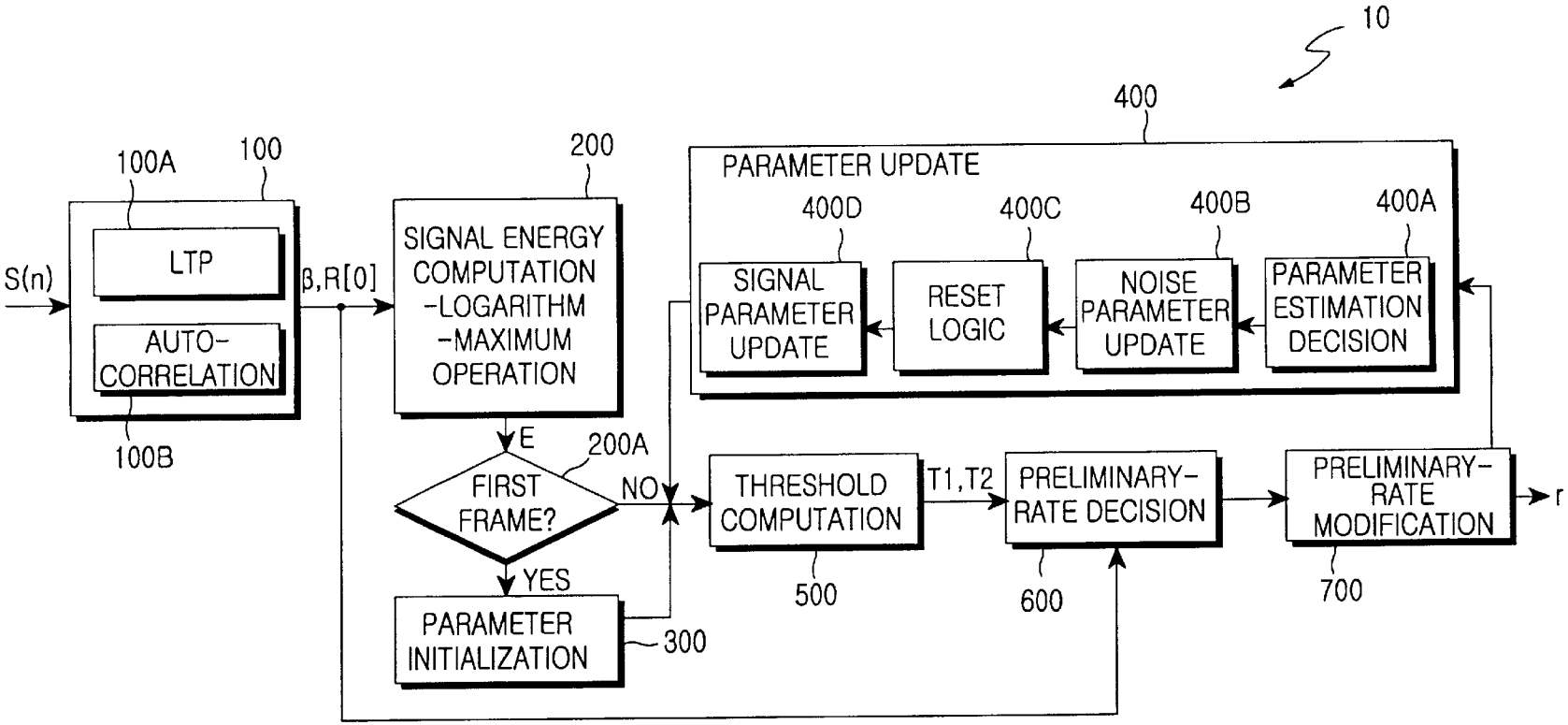
FIG. 1 is a block/flow diagram of an apparatus/method for determining a speech-encoding rate according to an embodiment of the present invention.

A preferred embodiment of the present invention will be described herein with reference to the accompanying drawing. In the following description, well-known functions or constructions are not described in detail so as not to obscure the present invention. For explanatory purposes, the input speech is assumed to be in the form of 16-bit samples ranging in value from −32,768 to 32,767. It is further assumed that the sampling rate is 8000 samples per second. Note that the utility of this invention does not depend in any way on the specific bit-depth or sampling rate of the input signal. The specifics of the implementations can be adapted to any reasonable sample size (bit length) and bit-rate.

Referring to FIG. 1, a schematic block diagram of a speech encoding rate-decision apparatus 10 in accordance with a preferred embodiment of the present invention is illustrated. The shown diagram is also understood to illustrate a rate-decision method in accordance with the invention. The apparatus 10 implements the rate decision corresponding to a current frame of speech using thresholds computed from quantities determined in the previous frame. These quantities are then updated using the signal energy and long term prediction gain from the current frame.

Rate-decision apparatus 10 determines a preliminary encoding rate by comparing the current frame energy to a set of thresholds that depend on the background noise level and its variation. The estimate of the variation of the noise level is used to set thresholds, and the thresholds are used to determine whether speech energy is present or not. In contrast to the IS-127 rate-decision algorithm, these thresholds are independent of the SNR (signal to noise ratio) and are applied to the full-band signal. The preliminary rate decision is modified based on the value of the long-term prediction gain $\delta$. Hangover logic is implemented to avoid rapid (and potentially audible) fluctuations between rates. Finally, the estimated parameters used to set the threshold are updated.

Table 1 below defines variables used in rate-decision computations in accordance with the invention to be described hereafter.

TABLE 1

| | |
|---|---|
| Input | |
| Long-term prediction gain | $\beta$ |
| First autocorrelation coefficient (signal energy) | R[0] |
| Maximum rate constraint | $r_{max}$ |
| Minimum rate constraint | $r_{min}$ |
| Output | |
| Rate decision | r |
| State Variables | |
| Rate decision of the previous frame | $r_{last}$ |
| Average log signal energy | /E |
| Average log noise energy | $/E_n$ |
| Smoothed, minimum-tracking signal energy | $E_t$ |
| The logarithm of the energy of the last frame | $E_{last}$ |
| Variation of the log noise energy | $\delta_n$ |
| The mean-crossing rate of the signal | $/\omega$ |
| A threshold used in a dual-time-constant filter | $T_3$ |
| The previous background noise update decision | $d_{last}$ |
| A flag indicating abrupt drop in signal energy | $f_d$ |
| The remaining number of hangover frames | h |
| Intermediate variables | |
| Background noise update decision | d |
| The mean crossing rate signal | x[n] |

Referring still to FIG. 1, the speech-encoding rate decision depends on the first autocorrelation coefficient R[0] and long term prediction (LTP) gain $\beta$. The long term prediction gain b is computed in the long term prediction computational element 100A of computational block 100. R[0] is computed in a signal energy computation element 100B of block 100. The logarithm signal energy computation element 200 computes the logarithm of the signal energy using the first autocorrelation coefficient R[0]. Computational element 200 also defines a maximum signal energy value for use in making the rate decision.

The rate decision is based on the measured signal energy value and the long-term prediction gain. In the present embodiment, the signal energy value is the logarithm of the signal energy; other embodiments may use alternative measurement units. The logarithm of the signal energy output (E) from the logarithm signal energy computation element 200 is computed as follows:

$$E=\max(\log(\mathbf{160}), \log(R[\mathbf{0}])),$$

where log (160) is a preselected constant.

If the current frame is the first frame, then the parameters describing the signal energy and the background noise energy must be initialized. For the first frame (which is verified at query element 200A) the parameters are initialized by a parameter initialization element 300, as follows:

$/E=E$ $E_t=E$ $/E_n=0$ $\delta_n=0.05$ $T_3=1$ $d_{last}=1$ $r_{last}$=Full rate $E_{last}=0$ Thus, if the value log (R[0]) calculated by block 200 is less than log (160), then the logarithm of signal energy (E) is set as log (160)=2.204. The mean energy (/E) and the minimum tracking energy ($E_t$) both depend on the value of the energy in the first frame.

A threshold computation element 500 computes two thresholds for use in determining the encoding rate according to the following formula:

$$T_1=/E_n+6\delta n$$

$$T_2=/E_n+3\delta n$$

where /En is the average log noise energy, and the variation of the log noise energy $\delta_n$, was initially set to 0.05.

All signals with energy that is close to the energy of the background noise, i.e., less than the threshold T2 in this example, will be classified as background noise frames and encoded at one eighth of the full encoding rate. Other frames are assumed to contain speech and are encoded at higher rates. Initially, the background noise energy, $/E_n$, is set to zero.

The preliminary rate decision element 600 computes the preliminary rate and the hangover by comparing the energy of the current frame with the thresholds computed above. The rate decision and hangover are computed as follows:

$$r=1(\text{Full}),\ E>T_1\ \tfrac{1}{2}(\text{Half}),\ T_1>E>T_2\ \tfrac{1}{8}(\text{Eighth}),$$

otherwise.

$$h=4,\ E>T_1 h,$$

otherwise.

(It is noted here that throughout this detailed description, an expression for a variable which indicates equality to the same variable, such as h=h or r=r, mean that the new value for the particular variable is set equal to the latest value for that variable. That is, the value for the particular variable is not modified from the previous value.)

The hangover is independent of the SNR, in contrast to the IS-127 RDA. High rates are chosen when the signal energy is high relative to the background noise energy. When the signal energy is comparable to the background noise energy, the lowest rate is chosen.

A preliminary-rate modification element 700 finally outputs the speech-encoding rate by modifying the preliminary rate determined by the preliminary rate decision element 600. Such a modification is required if the long term predication gain is extremely low, which indicates that the signal has very little speech-like structure and can be encoded at a low rate.

For example, if the long term predication gain ($\beta$) is below a first predetermined long term prediction gain threshold (e.g., $\beta<0.2$), then the preliminary rate is modified to 1/8 (if not already set to 1/8). If the long term predication gain ($\beta$) is above this threshold, the preliminary rate is not modified. Thus, $$r=1/8,\ \beta<0.2$$

r, otherwise.

For frames with a long term prediction gain lower than a second, lower gain threshold (e.g., $\beta<0.1$), the hangover interval is reduced. That is, $$h=h-1,\ \beta<0.1$$

h, otherwise.

The preliminary rate decision is modified to take into account hangover and minimum and maximum rate constraints. When a hangover is in progress (h>0), if the speech-encoding rate of the previous frame is full-rate and the encoding rate of the current frame is a lower rate, for example, half-rate or eighth rate, then the encoding rate of the current frame should be reset to full-rate and the hangover count should be decreased. The following pseudo-code (written in the C language) implements these changes:

```
If ((r_last == Full) and (r! = Full)) {
    if (h>0) {
        r = Full;
        h = h − 1
    }
}
```

Embodiments of the present invention can be designed to maintain compatibility with IS-127 based vocoders. IS-127 specifies that a full rate frame cannot be followed immediately by an eighth-rate frame; instead, a half rate packet is inserted. It is desirable to include this feature within vocoders implementing the present invention. Without this feature, any IS-127 compatible decoder would detect an error condition each time a full-rate to eighth-rate transition was encountered. This constraint is implemented in the following program code:

```
if ((r_last == Full) and (r == Eighth)) {
    r = Half;
}
```

In any event, whether or not the above feature is included, minimum and maximum rate constraints are applied, and the rate decision of the previous frame ($r_{last}$) is updated as follows:

$$r=r_{max},\ r>r_{max}r_{min},\ r<r_{min}r,$$

otherwise.

$$r_{last}=r.$$

Thus, if the preliminary rate decision (r) is higher than the maximum rate constraint ($r_{max}$), then the maximum rate constraint ($r_{max}$) is finally chosen as the encoding rate, and so forth.

With continuing reference to FIG. 1, after the final preliminary rate decision has been computed, the parameter update block 400 updates parameters used for computing the thresholds $T_1$ and $T_2$. The thresholds $T_1$ and $T_2$ depend upon estimates of the noise level and the noise level variation. Also, these thresholds $T_1$ and $T_2$, in turn, depend upon average noise energy estimates.

The parameter update element 400 consists of a parameter estimation decision element 400A, a reset logic 400C, a noise parameter update element 400B and a signal parameter update element 400D. To implement the parameter update, first, the parameter estimation decision element 400A must indicate whether the current signal segment consists of noise only or speech and noise. The principle used to distinguish noise only from speech and noise is that the signal energy is at a minimum when it consists of noise only. In principle, the noise level can be estimated by calculating the minimum signal energy. However, this simple approach has two drawbacks. One is that due to the random character of the noise, the minimum signal value can be too low to accurately represent the average noise level. The second drawback is that a method which tracks the minimum signal energy will not be able to adapt to an overall increment of the background noise energy. The background noise estimation procedure described below (steps I and II) addresses both of these problems:

I. Estimation of Mean Crossing Rate.

In order to monitor for a large increase in background noise energy, the mean crossing rate is estimated. Herein, the mean crossing rate represents the rate at which the total mean value of the signal energy for a number of frames crosses the signal energy of the present frame. When this "mean-crossing rate" is high (e.g., higher than 0.35), a steady state is indicated which typically means that the signal consists of background noise only. In other words, since noise is random in nature, then in the absence of a signal, the "signal energy" of the present frame will cross above and below the total mean value of the "signal energy" on a more frequent basis (i.e., higher mean crossing rate) than would be the case if a significant signal were present.

The mean crossing rate (/w[n]) is computed by generating the crossing rate signal x[n], which is 1 when the signal energy in the $n^{th}$ speech frame crosses its mean (/E), and zero otherwise.

$$E_{last}>/E \text{ and } E</E\ X[n]=1$$

or $$E_{last}</E \text{ and } E>/E0$$

otherwise.

The mean crossing rate (/w[n]) is the output of the crossing rate single pole filter with time constant 0.98 and is computed with respect to the input signal x[n] in accordance with the following equation:

$$/\omega[n]=0.98/\omega[n-1]+0.02x[n]$$

II. Determining Whether to Update Background Noise Parameter Estimates.

In this step, it is determined whether or not to update the background noise parameter estimates based on the average log signal energy (/E), the minimum tracking signal energy ($E_t$), and the average log noise energy ($/E_n$). If the logarithm of the signal energy (E) is below its mean (/E) and the estimated average log noise ($/E_n$) is above the minimum tracking signal energy ($E_t$), the noise parameters will be updated. Also, if the noise parameters were updated on the previous frame and the energy is significantly below its mean (/E), the noise parameters will be updated. The second condition allows low energy signals to be classified as noise frames even when the minimum tracking energy exceeds the estimated background noise energy (as will happen due to random fluctuations).

If the parameters are to be updated, the mean crossing rate is reset to zero. Also, if the signal energy is zero, the noise parameters are not updated. The update decision is implemented by means of the following program code:

```
If ((E < /E) and (/E_n > E_t))
{
    d = 0
    /ω [n] = 0
}
else if (d_last == 0)
{
    if (E < /E + 3 δ n)
```

-continued

```
        {
        d = 0;
        /ω [n] = 0;
        }
        else
        {
            d = 1;
        }
    }
    else
    {
        d = 1;
    }
    if (E < E_last - LOG_ALPHA)/*don't
    update during digital silence*/
        d = 1
```

If the update decision variable satisfies d=0, the current signal is assumed to consist of background noise only in the noise parameter update element 400B. In this case, the noise energy and its variance are updated. The background noise energy estimate is the output of a single pole filter with the log energy of the current frame as input. The background noise variation is computed as the output of a single pole filter with input that is the magnitude of the difference between the log energy in the current frame and the current estimated noise energy. The noise variation is only updated if there is no significant drop in the signal energy from the last frame. This prevents large amplitude excursions in the noise variation signal due to transitions from speech to noise. During the transitions, the noise energy may differ slightly to substantially from the signal mean. Also, the growth rate of the noise energy variation is limited to 1.05 and a minimum energy constraint is imposed.

This update is illustrated by the following program code:

```
If (d == 0) {
    /*update noise energy estimate*/
    /E_n= 0.98/E_n + 0.02 E, /E_n < /E
    0.98/E_n + 0.02/E, otherwise
    if (f_d == 0)
    {
    δn = max (min_noise_erg, min
    (1.05 δn, 0.98 δn + 0.02 |E − /E_n|);
    }
    /*update decision memory*/
    E_last = E;
    d_last = d;
```

The noise variation is computed using an absolute value and is not updated when a significant drop in energy has occurred. This prevents the estimate of the noise variation from becoming inaccurate due to large values that occur during a significant drop in signal energy near transitions from speech to background noise.

The Reset Logic Element 400C determines whether state variables should be re-initialized due to the estimate of the background noise level and its variation. If the mean-crossing rate (/ω[n]) is high, it is assumed that an increase in background energy has occurred. In this case, the noise energy and its variation are re-initialized as illustrated by the following program code in the reset logic 400C:

```
If (/ω [n] > 0.35)
{
    /E_n = /E;
```

-continued

```
    δn = //E − E_last/;
    T_3 = 1;
    d_last = 1;
    /ω [n] = 0;
}
```

This re-initialization allows the rate decision algorithm to adapt to increases in background noise energy.

Finally, the long-term average log signal energy (/E) and minimum tracking signal energy ($E_t$) are updated in the signal parameter update element 400D. Herein, the minimum tracking signal energy ($E_t$) is the output of a dual-time constant filter that computes a long-term average log signal energy (/E) when the logarithm of the energy (E) is increasing and a short-term average log signal energy (/E) when the logarithm of the energy (E) is decreasing. An indicator flag ($f_d$) is set when the logarithm of the energy (E) is decreasing (E<T3). These computations are performed according to the following formulation:

$$E_t=0.9688E_t+0.0312E,\ E>T_3 0.25E_t+0.75E,$$

otherwise $$f_d=1,\ E<T_3 0,$$

otherwise.

$$/E=0.9688/E+0.0312E$$

$$T_3=/E-\delta_n.$$

The speech encoding rate decision according to the preferred embodiment of the present invention effectively acts on each speech frame of 160 samples and thus, can be applied to the EVRC vocoder by means of a slight modification within the capability of the skilled artisan.

The above-described rate decision apparatus and method for a variable rate vocoder includes the following three novel features: First, a simple technique is used to estimate the level and variation in the background noise. This technique involves tracking large changes in background noise. Second, the rate is determined using a combination of the estimated noise level and the long term prediction gain. Taken together, these features eliminate the need for an accurate estimate of the average signal level for a signal-to-noise ratio calculation (as required in the IS-127 RDA); and eliminate the need for the bandsplitting required in the IS-127 RDA. Third, this new method has the potential to reduce the computational complexity of the overall speech encoding algorithm because the number of autocorrelation coefficients necessary for the rate decision drops from 17 to 1.

While the invention has been shown and described with reference to a certain preferred embodiment thereof, it will be understood by those skilled in the art that the present invention should not be limited to the specific embodiment illustrated above. Therefore, the present invention should be understood as including all possible embodiments and modifications which do not depart from the spirit and scope of the invention as defined by the appended claims.

What is claimed is:

1. An apparatus for determining a speech-encoding rate in a variable rate vocoder comprising:

a threshold computation means for computing a set of thresholds based on a background noise energy level and background noise energy variation;

a signal energy computation means for computing a signal energy value of an input signal;

a rate-decision means for determining said speech-encoding rate by comparing the computed signal energy value with the thresholds computed by said threshold computation means; and a hangover computation means for determining a hangover interval by comparing the computed signal energy value with the thresholds computed by said threshold computation means.

2. The apparatus of claim 1, wherein said set of thresholds comprises first and second energy thresholds T1 and T2, respectively, with T1 being larger than T2, and said speech-encoding rate is determined as equal to: a highest rate if said signal energy value is above T1; a second highest rate if said signal energy value is between T1 and T2; and a lowest rate if said signal energy value is less than T2.

3. A speech-encoding rate decision apparatus in a variable rate vocoder comprising:

a signal energy computation means for computing a signal energy value of an input signal;

a threshold computation means for computing at least two energy thresholds based on a background noise energy level and background noise energy variation;

a preliminary rate decision means for computing a preliminary encoding rate and a hangover interval by comparing the computed signal energy value with the energy thresholds computed by said threshold computation means; and a preliminary rate modification means for modifying the preliminary encoding rate to take into account hangover constraints, a long term prediction gain derived from said input signal, and minimum and maximum rate constraints and outputting the modified rate as a final speech-encoding rate for a current frame of said signal.

4. The apparatus of claim 3, wherein said preliminary rate modification means modifies said preliminary encoding rate (r) by setting r equal to a predetermined low encoding rate if said long term prediction gain (β) is below a first prediction gain threshold, and maintains r unchanged if β is higher than said first prediction gain threshold.

5. The apparatus of claim 4, wherein said first prediction gain threshold is about 0.2 and said predetermined low encoding rate is about 1/8.

6. The apparatus of claim 4, wherein:

said preliminary rate modification means further determines a current hangover count for said current frame by modifying a previous hangover count for a previous frame;

said current hangover count is determined as one hangover count less than said previous hangover count if β is below a second prediction gain threshold, said second prediction gain threshold being less than said first prediction gain threshold; and said current hangover count is determined to be equal to said previous hangover count if β is above said second prediction gain threshold.

7. The apparatus of claim 6 wherein said first prediction gain threshold is about 0.2 and said second prediction gain threshold is about 0.1.

8. The apparatus of claim 3, wherein:

said signal energy value (E) is expressed in logarithmic units and computed in accordance with the following equation:

$$E=\max(\log(K), \log(R[0])),$$

where K is a constant and R[0] is a first autocorrelation coefficient.

9. The apparatus of claim 3, wherein the threshold computation means computes a first energy threshold T1 as the sum of an average noise energy $/E_n$ and a first energy value, said first energy value equaling the product of a first constant multiplied by $\delta_n$, where $\delta_n$ represents a variation of noise energy, and computes a second energy threshold T2 as the sum of $/E_n$ and a second energy value, said second energy value equaling the product of a second, smaller constant multiplied by $\delta_n$, and, said preliminary rate being determined as equal to: a highest rate if said signal energy value is above T1; a second highest rate if said signal energy value is between T1 and T2; and a lowest rate if said signal energy value is less than T2.

10. The apparatus of claim 9 wherein said first constant is about six, said second constant is about three, said second highest rate is about one half of the highest rate and said lowest rate is about one eighth of the highest rate.

11. The apparatus of claim 10 wherein a hangover interval (h) for a current frame of said input signal is set equal to four if said signal energy level is below T1; else h is set equal to a hangover interval for the previous frame.

12. The apparatus of claim 11 wherein:

said preliminary rate modification means modifies said preliminary encoding rate by setting it to a predetermined low encoding rate if said long term prediction gain (β) is below a first prediction gain threshold; and said preliminary rate modification means reduces said hangover interval for the current frame by one if β is below a second prediction gain threshold, said second gain threshold being less than said first prediction gain threshold.

13. The apparatus of claim 3, wherein said apparatus further comprises a parameter update means for updating parameters for use in computing thresholds T1 and T2 by the threshold computation means after determination of said final speech-encoding rate (r) for the current frame.

14. The apparatus of claim 13, wherein the thresholds T1 and T2 are determined based on: a noise level, variation estimates of said noise level, and an average signal energy estimate of said input signal.

15. The apparatus of claim 13, wherein the parameter update means comprises:

a noise parameter update means for updating the noise energy and its variation when the present signal consists of only background noise; and a signal parameter update means for computing a long term average value when the signal energy (E) is increasing and a short-term average value when the signal energy is decreasing in accordance with the following equation:

$$/E=(Q_1)(/E)+(R_1)(E),$$

where /E is an average signal energy value, and $Q_1$ and $R_1$ are constants.

16. The apparatus of claim 15 wherein $Q_1$ is 0.9688 and $R_1$ is 0.0312.

17. The apparatus of claim 15, wherein the signal parameter update means further comprises a dual-time constant filter, with a threshold T3 being used in the dual-time constant filter to determine whether the signal energy significantly drops, T3 being computed in accordance with the following equation:

$$T3=/E-\delta_n.$$

18. The apparatus of claim 15, wherein the signal parameter update means computes a minimum tracking means in accordance with the following equation:

$$E_t=Q_1E_t+R_1E,\ E>T_3Q_2E_t+R_2E,$$

otherwise, where $Q_2$ is a constant which is less than $Q_1$ and $R_2$ is a constant which is greater than $R_1$.

19. The apparatus of claim 15, wherein in order to determine that the signal consists of only background noise when a mean crossing rate (/ω[n]) is higher than a predetermined mean crossing rate, the parameter update means further comprises a parameter estimation decision means for generating a signal x[n] that is 1 when the signal energy in the $n^{th}$ speech frame crosses its mean, and zero otherwise.

20. The apparatus of claim 19, wherein the predetermined mean crossing rate is 0.35.

21. The apparatus of claim 19, wherein the mean crossing rate (/ω[n]) is the output of a single pole filter with time constant 0.98 and computed to generate signal x[n] in accordance with the following equation:

$$/\omega[n]=0.98/\omega[n-1]+0.02x[n].$$

22. The apparatus of claim 19, wherein said apparatus further comprises reset logic for initializing energy values, wherein if the mean crossing rate (/ω[n]) is higher than the predetermined value, then the average noise energy ($/E_n$) is initialized to the average signal energy (/E), the noise energy variation ($\delta_n$) is initialized to ($|E-E_{last}|$), where $E_{last}$ is an energy value of the last frame, the threshold (T3) used in the dual-time constant filter is initialized to 1, a previous background noise update decision ($d_{last}$) is initialized to 1, and the mean crossing rate (/ω[n]) of the input signal is initialized to 0.

23. A method for determining a speech-encoding rate in a variable rate vocoder comprising the steps of:

(a) computing a signal energy value of an input signal;

(b) determining a preliminary rate and a hangover interval by comparing the signal energy value with a plurality of energy thresholds; and (c) determining said speech-encoding rate for a current frame by modifying the preliminary rate to take into account hangover constraints, a long term prediction gain and minimum and maximum rate constraints.

24. The method of claim 23, wherein said method further comprises the step of updating a noise parameter and a signal parameter when a frame consists of only background noise, after performing step (c).

25. The method of claim 23, wherein step (a) further comprises the step of initializing a parameter when the current frame is the first frame of the input signal.

26. The method of claim 23, wherein said plurality of energy thresholds comprise first and second energy thresholds T1 and T2, respectively, with T1 being larger than T2, and said preliminary rate determined in step (b) is determined as equal to: a highest rate if said signal energy value is above T1; a second highest rate if said signal energy value is between T1 and T2; and a lowest rate if said signal energy value is less than T2.

27. A method for determining a speech-encoding rate in a variable rate vocoder comprising:

computing a set of thresholds based on a background noise energy level and background noise energy variation;

determining a signal energy value of an input signal;

determining said speech-encoding rate by comparing the computed signal energy value with said set of thresholds; and modifying a preliminary rate to take into account hangover constraints.

28. The method of claim 27, further comprising modifying the preliminary rate to take into account a long term prediction gain and minimum and maximum rate constraints.

* * * * *

UNITED STATES PATENT AND TRADEMARK OFFICE

CERTIFICATE OF CORRECTION

PATENT NO. : 6,397,177 B1
DATED : May 28, 2002
INVENTOR(S) : Steven Isabelle

It is certified that error appears in the above-identified patent and that said Letters Patent is hereby corrected as shown below:

Title page,
Item [54], should read as follows:
-- SPEECH-ENCODING RATE DECISION APPARATUS AND METHOD IN A VARIABLE RATE VOCODER --

Signed and Sealed this

First Day of October, 2002

*Attest:*

*Attesting Officer*

JAMES E. ROGAN
*Director of the United States Patent and Trademark Office*